United States Patent [19]

Drebes

[11] 3,950,228

[45] Apr. 13, 1976

[54] LEVELING ARRANGEMENT FOR COKE OVENS

[75] Inventor: Friedrich-Wilhelm Drebes, Bochum, Germany

[73] Assignee: Dr. C. Otto & Comp. G.m.b.H., Bochum, Germany

[22] Filed: Apr. 1, 1974

[21] Appl. No.: 457,107

[30] Foreign Application Priority Data

Apr. 7, 1973 Germany ..... 2317685

[52] U.S. Cl. ..... 202/270; 201/40; 214/23

[51] Int. Cl.[2] ..... C10B 29/00; C10B 45/00

[58] Field of Search ..... 202/262, 263, 269, 270, 202/248; 201/40; 214/23

[56] References Cited

UNITED STATES PATENTS

| | | | |
|---|---|---|---|
| 2,224,392 | 12/1940 | Imes | 214/23 |
| 2,268,316 | 12/1941 | Taylor | 214/23 |
| 2,290,568 | 7/1942 | McIntosh | 214/23 |
| 3,821,088 | 6/1974 | Barron | 202/263 |

*Primary Examiner*—Norman Yudkoff
*Assistant Examiner*—Darrell Sanders
*Attorney, Agent, or Firm*—Brown, Murray, Flick & Peckham

[57] ABSTRACT

At the machine side of a coke oven, a leveling rod is moved into a coke oven chamber through an opening surrounded by a frame on a removable oven door. A movable hood is positioned to define a horizontal extension to the opening in the coke oven door to thereby enclose a portion of the leveling rod during its movement into the oven chamber. A support member within the hood is arranged below the lower edge of the frame that surrounds the opening in the door. Bracket plates are carried by the support member such that the leveling rod moves upon the top surface of the uppermost plate. A removable bolt is employed to secure the bracket plates to the support member. The number of bracket plates used determines the elevation at which the leveling rod moves into the oven chamber. An extension insert is removably attached to the roof of the hood above the leveling rod.

6 Claims, 3 Drawing Figures

LEVELING ARRANGEMENT FOR COKE OVENS

BACKGROUND OF THE INVENTION

This invention relates to an apparatus for leveling coal that has been charged into an oven chamber of a battery of coke ovens. More particularly, the present invention relates to a horizontally movable leveling rod supported on a carriage for displacement along the battery of coke ovens together with apparatus whereby the leveling rod can be positioned for introduction at a preselected elevation into an oven chamber through an opening in an oven door.

As is known, dust-containing gases are produced when coal which is fed into the oven chamber, comes into contact with the hot chamber walls. When a leveling rod is pushed into the oven chamber and as it moves back and forth through an opening in the oven door, there is a chance that such gases may escape if the gases are not drawn off at another location in the oven chamber. Efforts to counteract the risk of escaping gases during leveling have been directed to utilizing the smallest possible opening in the oven door for the entry of the leveling rod into an oven chamber. It is desirable, on the other hand, to have the capability of altering the filling height of the coal in the oven chamber when the type of coal to be coked is changed and when using the type of coal having different shrinkage capacities. Also, it may be that from time-to-time, changes to the filling height of the coal in a coke chamber will affect the character or nature of the conversion of carbon compounds contained in the distillation gas that is created while such gas travels to a gas-collecting area. A special and different situation with regard to the leveling height of the coal charged into an oven chamber is also encountered when after part way through the coking process, a layer of fine coal, e.g., coal slack and coal dust, is fed into the oven chamber if this additional fine coal is to be leveled.

It is known in the art to support a leveling rod upon a movable rig in such a manner that the leveling rod may be operated at various levels or heights. In order to facilitate the introduction of the leveling rod into an oven chamber at various heights or levels, the opening in the oven door, which may be closed by means of a special door or lid, must be at a particular height. However, if the top surface of the coal charge in the oven chamber is located at a level which is higher than the lower edge of the opening in the door, then the lower portion of the opening in the door must be covered so that the coal in the oven chamber is not thrown out by the leveling rod as it moves during the leveling operation.

There are known types of oven doors at the machine side of coke oven chambers onto which plates can be adjustably attached by screws to define a coal level height within a larger opening in the oven door. These plates are bolted onto the door in such a manner that the remaining horizontal opening receives the leveling rod at the intended or proposed level of the coal charge in the chamber. This protects the portion of the coal located below the opening in the door from being thrown out during the leveling operation. A portion of the opening located above the leveling rod may be closed by an attached plate, thus preventing flue gases from escaping. If, for example, in connection with the type of oven door presently under discussion, the level or height of the coal charge in the oven chamber is to be changed, then all the plates affixed to each door for the oven chambers must be unbolted and if required, bolted again to the doors at a different level or elevation. In addition to the considerable amount of work required when a change is contemplated to the coal charge height, the plates attached to the doors also tend to become fused, for example, burned or sintered onto the door, so that it is, in many instances, not even possible to loosen the bolts attaching the plates to the door.

SUMMARY OF THE INVENTION

It is an object of the present invention to provide in a simplified manner a way of obtaining an operating level of a leveling rod at higher or lower levels without alterations to the coke ovens along with at the same time eliminating excessive amounts of escape of flue gases during the leveling operation. It is necessary, however, that the opening in an oven door, which is closed by a leveling door, have a sufficient height to accommodate the possible adjustments to the height of the coal charge to be carried out by the leveling rod.

In one form of the present invention, there is provided in a battery of coke ovens, an apparatus for leveling coal in a coke oven chamber having a removable door for closing the machine side of the oven chamber, the removable door having an opening therein, the apparatus comprising: a leveling rod including drive means supported for movement along the battery of coke ovens, a frame surrounding the opening in the removable door, means for selectively closing the opening in the removable door, hood means including a movable wall defining front and back openings for positioning into an operative position to define a horizontal extension to the openings surrounded by the frame to thereby enclose a portion of the leveling rod during movement into a coke chamber, a support member within the hood means arranged below the lower edge of the frame, bracket plates carried by the support member such that the leveling rod is displaced into an oven chamber upon the top surface of the uppermost plate, and fastening means for securing the bracket plates to the support member.

More specifically, in accordance with the present invention, there is provided a projecting hood having the shape of a horizontal pipe that has open the front and back ends for enveloping part of the leveling rod's path and situated parallel to the leveling rod with respect to its movement into the oven chamber. The hood is supported in a movable manner upon the carriege used to support the leveling rod and its drive such that the hood is movable parallel to the movement of the leveling rod. In its inoperative position, the hood is carried along with the carriage supporting the leveling rod and moved into an operative position for the actual leveling operation. The edge of the hood is constructed and arranged to fit against the periphery of the frame for the leveling door whereby the front opening of the hood comes to rest in a sealed manner against the frame. Directly beneath the lower edge of front opening in the hood there is arranged a support for a number of bracket plates, the uppermost of which carries the leveling rod as it moves into the oven chamber. The bracket plates can be fastened to the support by a bolt. Thus, by selecting an appropriate number of bracket plates one can adjust the leveling opening in an oven door to a higher or lower level at which the leveling rod is introduced into the oven chamber. The bracket plates need not be flush with the interior edge of the hood but may extend beyond the lower edge of the hood's funnel opening into the leveling opening in the door for a relatively long distance. Preferably, the hood includes a bottom wall starting at the funnel opening at the lower edge and sloping in a diagonal direction away from the furnace door such that the bottom wall at its lower edge extends into a bin which is carried by the carriage for the leveling rod to collecting coal that overflows from the oven chamber. In regard to instances wherein the leveling rod is located at a relatively low level, thus creating a rather large open area between the leveling rod and the roof portion of the hood, through which charging gases might escape from the oven chamber, it is preferred according to the present invention to employ downwardly extending insert or filler piece extending across the upper edge of the opening at the front of the hood. The insert may be designed to enclose the upper edge of hood in a bifurcated manner. Alignable openings are formed in the roof of the hood and in the extension inserts at spaced-apart locations. The portion of the insert above the hood is provided with a fork-like construction. Bolts are inserted through these openings to anchor the extension piece at the desired location. In order to reduce weight and thereby provide a lightweight construction, the portion of the extension insert located beneath the roof of the hood may be hollow. Extension inserts of varying heights may be employed to accommodate variour levels at which the leveling rod is to be situated during a given leveling operation.

Thus, the present invention facilitates the changing of the filling height of coal for the entire battery of coke oven chambers by making simple adjustments to one single component. More specifically, the changing of the filling height of coal in an oven chamber is carried out by adjusting the height of the leveling rod and changing the number of bracket plates together with, if desired, changing the upper extension insert on a hood which is movably situated on the carriage for the leveling rod.

These features and advantages of the present invention as well as others will be more fully understood when the following description is read in light of the accompanying drawings, in which.

Figure 1:
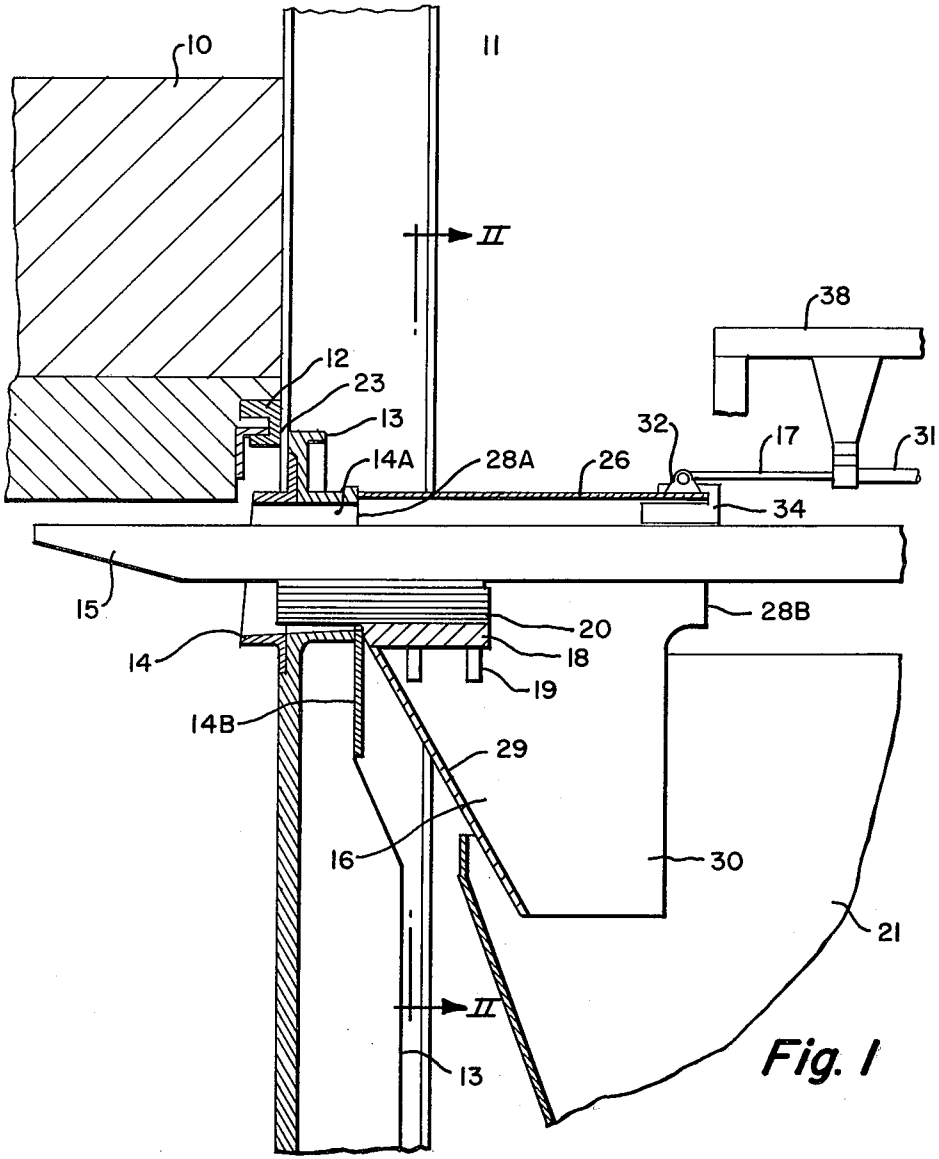
FIG. 1 is a vertical sectional view illustrating the apparatus for leveling coal in a coke oven chamber according to the present invention.

In FIG. 1, there is illustrated a vertical section through the upper portion of one of a battery of coke oven chambers, each having an oven door enclosing the end of the oven chamber in a manner well known in the art per se. The arrangement of parts illustrated in FIG. 1 includes a leveling rod for displacement into the oven chamber. Before this occurs the rod moves through a hood apparatus that has been operatively positioned in relation to the coke oven door. Each coke oven includes a roof 10 and anchoring stands 11 at opposite ends for supporting the masonry of the oven chamber. A door frame 12 surrounds the opening in the oven chamber at the machine side thereof. An oven door 13 carries a flexible knife-edge seal 23 about the periphery of the door for sealed contact with the door frame 12. A frame 14 surrounds a leveling opening 14A in the oven door. A removable leveling door 14B forms a closure for the leveling opening 14A after completing the leveling operation of a coal charge in the oven chamber.

Figure 2:
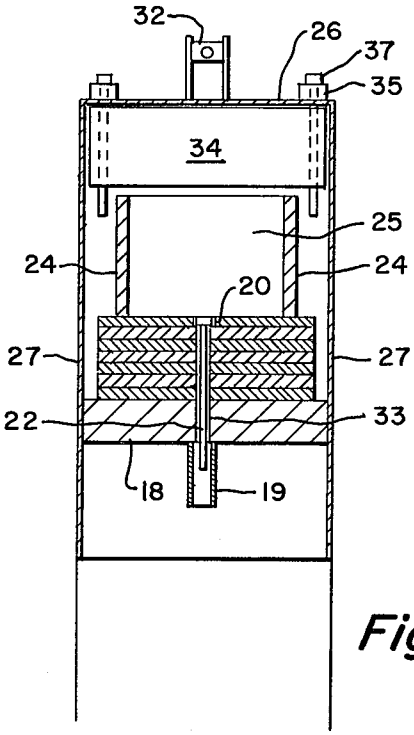
FIG. 2 is a sectional view taken along line II—II of FIG. 1.

As shown in FIGS. 1 and 2, a leveling rod 15 includes two side walls 24 connected together by a flange 25. A suitable drive, not shown, is provided for displacing the leveling rod in a horizontal direction for passage through the leveling opening 14A and into the oven chamber. The leveling rod and its drive are movably supported by a carriage, not specifically shown, for displacement along the various oven chambers making up a battery of coke ovens. Thus, the oven chamber illustrated in FIG. 1 is but one of a plurality of oven chambers.

In FIG. 1, there is illustrated a pipe-shaped hood 16 in its operative position wherein the pipe shape of the hood envelops the path of the leveling rod during its passage into the oven chamber. The hood 16 includes a roof 26 connected at its opposed edges to side walls 27, FIG. 2. The anterior opening 28A of the hood is shown in a sealed relation with the frame 14. The leveling rod enters into the hood through the posterior opening 28B. The hood includes a downwardly-sloping floor 29 that adjoins the lower edge of the side walls. A sloping floor plate, together with the vertical lower extensions 30 of the hood, form a pipe-shaped bottom outlet which extends above a bin 21 that is firmly installed on and carried by the previously described carriage for the leveling rod. This carriage further includes support members 38 to which is secured a piston and cylinder assembly 31 having its rod end 17 connected to a bracket 32. This bracket is rigidly secured to the front portion of the hood 16. Upon actuation of the piston and cylinder assembly 31, the hood 16 is moved between an inoperative position wherein it is remotely located from the coke oven door for movement transversely along the battery of coke ovens and into an operative position wherein it forms a smoke-tight connection with the frame 14 surrounding the charging opening in an oven door. It is important that the hood 16 when remotely positioned from the coke oven door has sufficient space for moving it beyond each of the anchor supports 11 as the carriage which supports the hood moves from oven chamber to oven chamber.

A plurality of bracket plates 20 are placed one on top of the other and carried by a support plate 18. The upper edge of the support plate 18 is arranged at such an elevation that it is flush with the lower edge of the anterior opening 28A in the hood. The support plate 18 as well as the bracket plates 20 are provided with vertical bores 30. A pipe 19 secured to the lower surface of the plate 18 forms an extension to the bores 30 when aligned therewith. A bolt 22 inserted through the vertical bores 30 is used to attach the plates 20 to the support plate 18 as shown in FIGS. 1 and 2.

As illustrated in FIG. 1, the leveling rod 15 moves along the top surface of the uppermost bracket plate as it is moved longitudinally with respect to the oven chamber. The number of bracket plates situated between the leveling rod and the support plate 18 determines the elevation of the leveling rod thus, the leveling height of the coal in a coke oven chamber. As indicated previously, the hood 16 is movable into a sealed, abutting relation with the frame 14 surrounding the leveling opening in the coke oven door 13. Since the bracket plates 20 are carried via the support plate 18 by the hood 16, the plates serve to determine the elevation at which the leveling rod enters into any given oven chamber. The plates 20 can be made of sufficient length such that they extend from the support member 18 into the opening surrounded by the frame 14 as clearly shown in FIG. 1.

Figure 3:
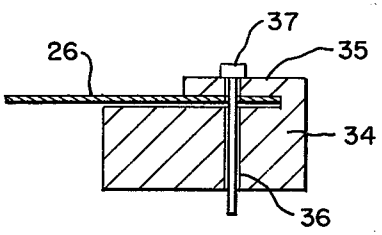
FIG. 3 is a partial elevational view in section similar to FIG. 1 but illustrating an extension insert attached to the roof of the hood apparatus shown in FIG. 1.

With reference now to FIG. 3, in those instances where too much space remains above the path of the leveling rod between it and the roof 26 of the hood, an extension insert 34 is employed. This insert includes upper guide arms 35 which bifurcate the inserts 34 for slideably receiving a portion of the upper wall 26 of the hood. Vertically arranged connecting pins or bolts 37 are insertable through aligned openings in the arms 35, the roof 26 of the hood and the body of the extension insert 34. As shown in FIG. 1, the extension insert 34 defines the end of the front opening 28 at the roof thereof. In order to save weight and facilitate a lightweight construction, the extension insert forms a hollow construction in the hood as best illustrated in FIG. 2. Two arms 35 are used to attach the extension inserts 34 to the hood at the sides of the vertical center plane of the hood in order to leave room for providing and attaching the bracket 32 to the hood which, in turn, is connected to the piston rod 17.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. In a battery of coke ovens, an apparatus to level coal in a coke oven chamber having a removable door for closing the machine side of the oven chambers, said removable door having an opening therein, said apparatus comprising:

a leveling rod including drive means supported for movement along the battery of coke ovens, a frame surrounding said opening in said removable door, means for selectively closing the opening in said removable door, hood means including a wall defining spaced front and back openings whereby the hood means forms a horizontal extension to the opening surrounded by said frame when the hood means is operatively positioned into a sealed relation with said frame to thereby enclose a portion of said leveling rod during its movement into a coking chamber, the wall of said hood means including a roof joined by spaced-apart side walls to a diagonally-sloping floor wall having a front edge commencing at said front opening, said diagonally-sloping floor wall diverging from said roof with the lower edge of the floor wall being extended in a direction away from the coke oven chamber and forming part of said back opening.

a bin arranged in a material receiving relation below said diagonally-sloping floor wall for movement along the battery of coke ovens with said leveling rod, a support member secured to said hood means and extending between said side walls above said diagonally-sloping floor wall, the upper edge surface of the support member being permanently arranged at an elevation within said hood such that it is essentially flush with the lower edge of said frame, a plurality of bracket plates to support said leveling rod while the bracket plates are carried by said support member, said leveling rod being displaceable into an oven chamber upon the top surface of the uppermost plate, said plurality of bracket plates being arranged one on top of the other and the aggregate height thereof as defined by the thicknesses of said plates is changeable to thereby define one of different preselected elevations at which the leveling rod operates within the oven chamber for leveling a coal charge therein, said bracket plates being constructed to support said leveling rod internally and externally of a coke oven chamber by extending through the opening surrounded by said frame, and fastening means for attaching said bracket plates to said support member.

2. The apparatus according to claim 1 further comprising an extension insert for attachment to said hood means, and means for attaching said insert to the roof of said hood means at a location remote from said frame surrounding the opening in the removable door.

3. The apparatus according to claim 2 wherein said inserts further include arms for overlying a portion of the roof of said hood means, said means for attaching further including bolts for passing through aligned openings in said hood means and said extension insert.

4. The apparatus according to claim 1 further comprising:

means for displacing said hood means into an abutting relation with said frame surrounding the opening in the removable door.

5. The apparatus according to claim 4 wherein said means for displacing include a piston and cylinder assembly.

6. The apparatus according to claim 4 further comprising a bracket extending from the roof of said hood means for engaging said means for displacing.

* * * * *